US009396824B2

(12) United States Patent
Agace

(10) Patent No.: US 9,396,824 B2
(45) Date of Patent: Jul. 19, 2016

(54) CONTAINER SYSTEM FOR RADIOACTIVE WASTE

(71) Applicant: Holtec International, Inc., Marlton, NJ (US)

(72) Inventor: Stephen J. Agace, Voorhees, NJ (US)

(73) Assignee: HOLTEC INTERNATIONAL

( * ) Notice: Subject to any disclaimer, the term of this patent is extended or adjusted under 35 U.S.C. 154(b) by 113 days.

(21) Appl. No.: 14/394,233

(22) PCT Filed: Apr. 15, 2013

(86) PCT No.: PCT/US2013/036592
§ 371 (c)(1),
(2) Date: Oct. 13, 2014

(87) PCT Pub. No.: WO2013/155520
PCT Pub. Date: Oct. 17, 2013

(65) Prior Publication Data
US 2015/0069274 A1 Mar. 12, 2015

Related U.S. Application Data

(60) Provisional application No. 61/624,066, filed on Apr. 13, 2012.

(51) Int. Cl.
*G21F 5/005* (2006.01)
*G21F 5/008* (2006.01)
*G21F 5/12* (2006.01)

(52) U.S. Cl.
CPC ..... *G21F 5/005* (2013.01); *G21F 5/008* (2013.01); *G21F 5/12* (2013.01)

(58) Field of Classification Search
CPC ..... G21F 5/005; G21F 5/008; G21F 5/0015; G21F 5/12
See application file for complete search history.

(56) References Cited

U.S. PATENT DOCUMENTS

| | | | | |
|---|---|---|---|---|
| 3,414,727 | A | 12/1968 | Bonilla | |
| 4,847,009 | A | 7/1989 | Madle et al. | |
| 5,018,772 | A | 5/1991 | Obermeyer et al. | |
| 5,475,721 | A * | 12/1995 | Baatz | H01B 7/06 376/272 |
| 6,625,246 | B1 * | 9/2003 | Singh | G21C 19/32 376/261 |
| 7,194,060 | B2 * | 3/2007 | Ohsono | G21F 5/008 220/4.04 |
| 7,628,287 | B1 * | 12/2009 | Arnold | B65D 7/045 220/62.18 |
| 2003/0147486 | A1 | 8/2003 | Singh et al. | |

(Continued)

OTHER PUBLICATIONS

Corresponding International Search Report for PCT/US2013/036592 dated Sep. 20, 2013.

*Primary Examiner* — Nicole Ippolito
*Assistant Examiner* — Sean Luck
(74) *Attorney, Agent, or Firm* — The Belles Group, P.C.

(57) ABSTRACT

A container system, for radioactive waste and method for using the same is provided. The system includes a canister configured for holding radioactive waste and a lid system. In one embodiment, the lid system comprises a two-part lid assembly including a confinement lid and a shielded lifting lid. The confinement lid is detachably mounted to the confinement lid. In use, the lifting lid supports die confinement lid for lifting and placement on the canister. The lifting lid further shields operators while the confinement lid is mounted to the canister. Thereafter, the lifting lid is removed and may be reused for confinement lid mountings on other canisters. In one embodiment, the confinement lid is bolted to the canister. The canister may be disposed in a protective overpack for transport and storage.

19 Claims, 18 Drawing Sheets

(56) References Cited

U.S. PATENT DOCUMENTS

2006/0215803 A1* 9/2006 Singh ..... G21F 5/002 376/272
2008/0086025 A1* 4/2008 Van Der Lee ..... G21F 5/015 600/3
2008/0210891 A1* 9/2008 Wagner ..... G21F 5/015 250/507.1
2009/0175404 A1 7/2009 Singh et al.
2010/0032591 A1* 2/2010 Lemer ..... G21F 5/015 250/507.1
2010/0272225 A1 10/2010 Singh

* cited by examiner

CONTAINER SYSTEM FOR RADIOACTIVE WASTE

CROSS-REFERENCE TO RELATED PATENT APPLICATIONS

The present application is a U.S. national stage application under 35 U.S.C. §371 of PCT Application No. PCT/US2013/036592, filed on Apr. 15, 2013, which claims the benefit of U.S. Provisional Patent Application No. 61/624,066 filed Apr. 13, 2012, the entireties of which are incorporated herein by reference.

FIELD OF THE INVENTION

The present invention relates container systems for holding radioactive waste, and more particularly to a waste canister that eliminates the need for a thick top lid on such containers.

BACKGROUND OF THE INVENTION

The thick top lid is one of the most expensive components of a radioactive waste canister. Such canisters may be used to store and transport non-fuel radioactive waste from nuclear generation plants such as activated reactor internals, control components, sundry non-fissile materials, and waste from operations such as resins, and in some applications vitrified nuclear waste fuel ("glass logs") encased in an outer metal cylinder. On existing canisters, the thick top lid is needed to shield personnel from radiation who are working on the lid (e.g. welding, bolting, fluid operations, etc.). The lid must also be thicker because the lid further performs the main canister lifting connection, and therefore must have the thickness needed for structural reasons to support the weight of the entire canister when hoisted via a crane or similar equipment used to move the canister. For these reasons, the thick top lid of a waste canister adds considerably to the overall weight and expense of the canister.

An improved radioactive waste canister is desired.

SUMMARY OF THE INVENTION

The present invention provides an improved radioactive waste canister system that overcomes the deficiencies of existing thick canister top lids. An embodiment of a canister system according to the present disclosure uses a thinner top-closure main confinement lid and a supplemental shielded lifting lid that combines the shielding and lifting functions into one component. In one embodiment, the confinement lid is detachably mounted to the underside of the lifting lid to form a two-part lid assembly. The confinement lid just performs the function of containment for radionuclides rather than also having a structural lifting role, thereby allowing the main closure confinement lid to be thinner in construction. The confinement lid is intended to remain in place on the canister after being loaded with radioactive waste and closed. The lifting lid is intended for temporary use for operator shielding during closure of the canister with confinement lid and for lifting. Advantageously, the two-pan lid system disclosed herein reduces the overall cost and weight of the final closed canister.

The canisters described herein are configured and dimensioned to be portable and transported by equipment suited for such applications, as opposed to permanently located spent nuclear fuel containment facilities. In one embodiment, canister lifting may be performed by a set of lifting bolts. The lifting bolts extend through the shielded lifting lid and main confinement lid into threaded lifting blocks that are attached to the canister body such as by welding. In use, the two-part lid system is typically used for temporary radioactive waste material storage and transport of the waste canister to a more remote location. Thereafter, the lifting lid is then removed remotely and an overpack lid is installed over the confinement lid to provide the necessary shielding of the canister for longer-term storage. Accordingly, the shielded lifting lid may advantageously be reused and can therefore be thicker than a traditional canister top lid as it is not dedicated for use with a single waste canister. Furthermore, the lifting lid may also be larger in diameter to cover the annulus space inside the top of the waste canister.

According to one embodiment of the present invention, a radioactive waste container system includes a canister having an interior chamber for holding radioactive waste and an open top, and a lid assembly comprising a confinement lid and a shielded lifting lid. The confinement lid is detachably mounted to the lifting lid. The confinement lid is configured for mounting on the canister and has a first thickness. The lifting lid includes a lifting attachment and has a second thickness. The confinement lid is independently mountable on canister from the lifting lid.

According to another embodiment of the present invention, a radioactive waste container system includes a canister having an interior chamber for holding radioactive waste and an open top, and a lid assembly comprising a lower confinement lid and an upper shielded lifting lid; the confinement lid being detachably bolted to the lifting lid. The lifting lid includes a plurality of first bolt holes having a first diameter and a plurality of second bolt holes having a second diameter, the first diameter being larger than the second diameter. The confinement lid includes a plurality of third bolt holes having a third diameter, wherein each of the third bolt holes is concentrically aligned with one of the first or second bolt holes of the lifting lid. A plurality of first mounting bolts is inserted through the first bolt holes and threadably attaches the confinement lid to the canister without engaging the lifting lid.

An exemplary method for storing radioactive waste using a container system is provided. The method includes the steps of: detachably mounting a confinement lid to a shielded lifting lid, the confinement lid and shielded lifting lid collectively forming a lid assembly; placing a canister having an interior chamber for holding radioactive waste into an outer protective overpack; lifting the lid assembly using the lifting lid; placing the lid assembly on an open top of the canister; attaching the confinement lid to the canister using a first set of mounting bolts without threadably engaging the lifting lid with the bolts; detaching the lifting lid from the confinement lid; and removing the lifting lid from the canister.

BRIEF DESCRIPTION OF THE DRAWINGS

The features of the exemplary embodiments of the present invention will be described with reference to the following drawings, where like elements are labeled similarly, and in which.

Figure 1:
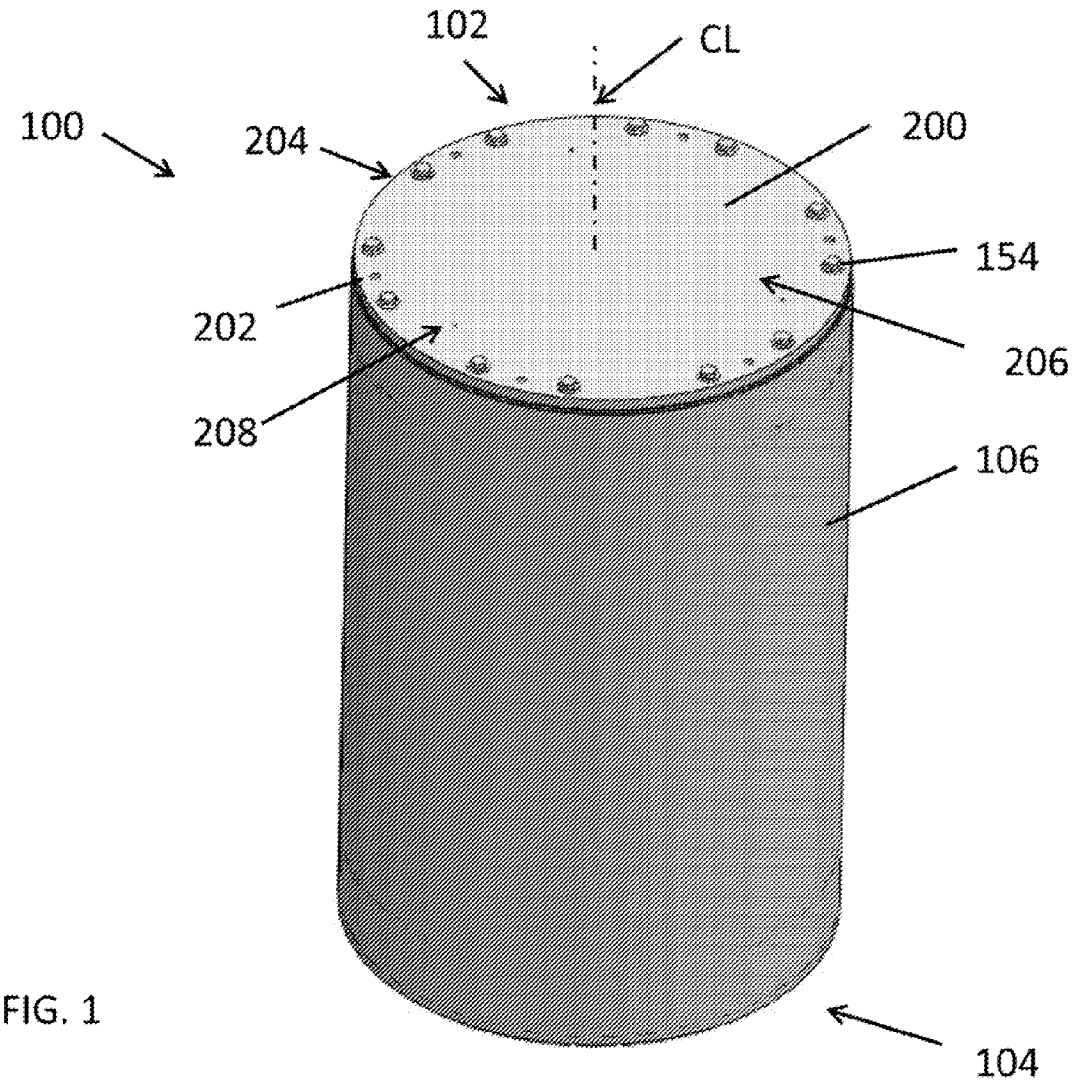
FIG. 1 is perspective view of a radioactive waste canister according to one embodiment of the present disclosure having a confinement lid mounted thereon.

All drawings are schematic and not necessarily to scale.

DETAILED DESCRIPTION OF THE EMBODIMENTS

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,". "above," "below." "up," "down," "top" and "bottom" as well as derivative thereof (e.g., "horizontally." "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

The present invention provides a separate, reusable shielded lifting lid for waste canister lid bolting and lifting. Accordingly, the lifting lid is bolted and not welded to the canister. The canister loading is dry in an overpack such as a metal cylindrical jacket holding the radioactive waste inside. Canisters typically have thick (e.g. 10 inch) steel lids on each canister to protect the operator from radiation during canister closure operations. The thick lids are heavy and expensive, and further not reusable as they remain attached to the canister for longer-term storage.

Advantageously, the present invention allows use of a significantly thinner main closure confinement lid (e.g. about 3 to 5-inch thick in exemplary embodiments) for radionuclides containment. After radioactive waste contents are placed in the canister, the confinement lid is installed and held in place by gravity alone in some embodiments. The confinement lid thickness, however, has generally poor radiation shielding value. Accordingly, the confinement lid is installed using a thicker and reusable shielded lifting lid which serves as an upper over-lid to the lower confinement lid. The two-pan lid system combination of the confinement lid and shielded lifting lid provide the thickness required to shield the operator from the radioactive canister contents during the canister closure bolting operations.

In use, the shielded lifting lid in one exemplary and non-limiting embodiment has holes that match the bolt spacing to allow the operator to install the confinement lid bolts in a radiation shielded environment. After the lifting lid bolts are installed, the operator hooks up the lifting rigging to the shielded lifting lid and moves away from the canister to a more distal and remote location. The shielded lifting lid may then be removed from the top of the canister, preferably with the confinement lid remaining in place, and a heavy overpack lid is installed for longer term storage and radiation shielding. Using this method, the waste canister and overpack advantageously are shorter, lighter, better shielded, and less expensive to fabricate.

Figure 2:
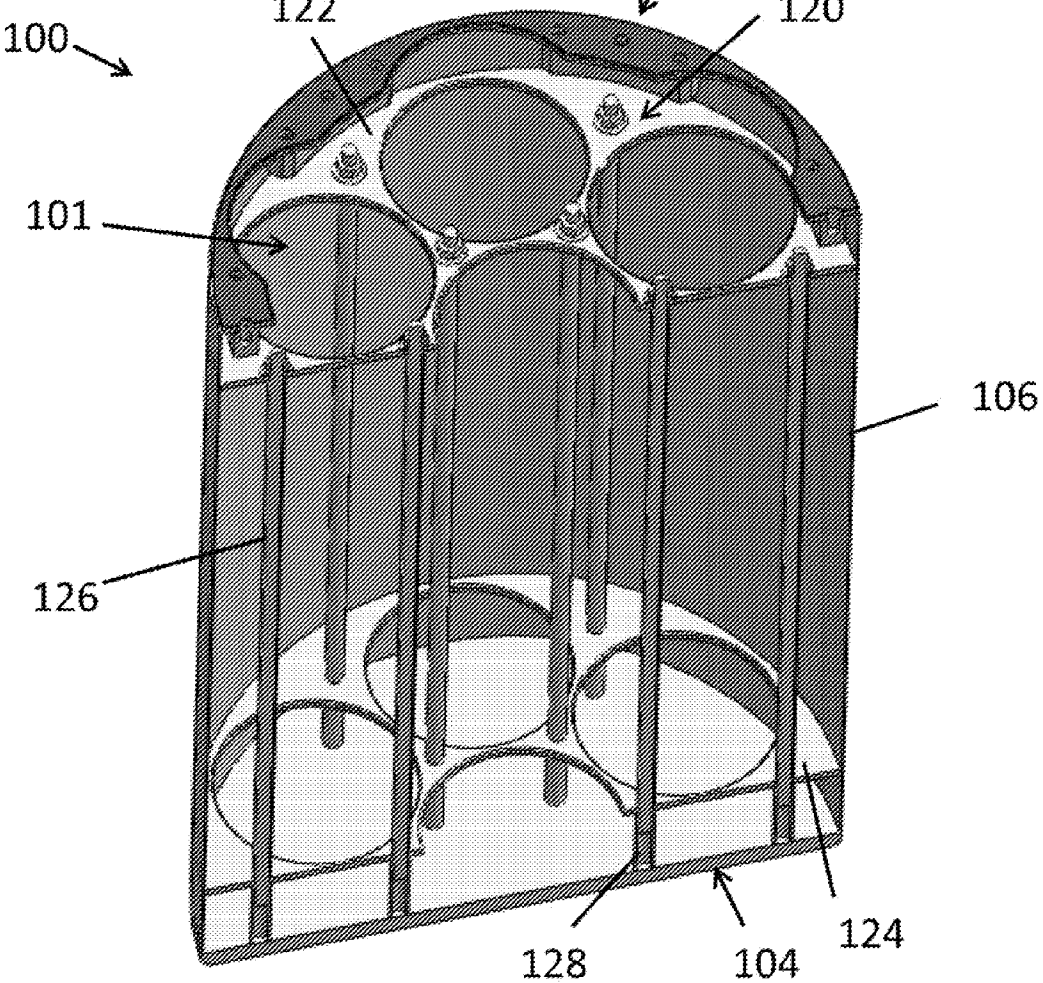
FIG. 2 is a cross-sectional perspective view thereof with confinement lid removed and showing a waste cylinder basket insert.

FIGS. 1 and 2 depict a radioactive canister system according to the present disclosure including a waste canister 100 having a generally cylindrical body defining an interior chamber 101 and comprised of a top 102, bottom 104, and cylindrical sidewall 106 extending therebetween. Top 102 is open for insertion of radioactive waste and bottom 104 is preferably closed in one embodiment. A main closure confinement lid 200 is shown attached to top 102 of canister 100 by a plurality of fasteners such as mounting bolts 154 which may be circumferentially spaced apart around the top of the canister, as further described herein. In one embodiment, canister 100 may be a non-fuel radioactive waste canister (NWC).

Figure 6:
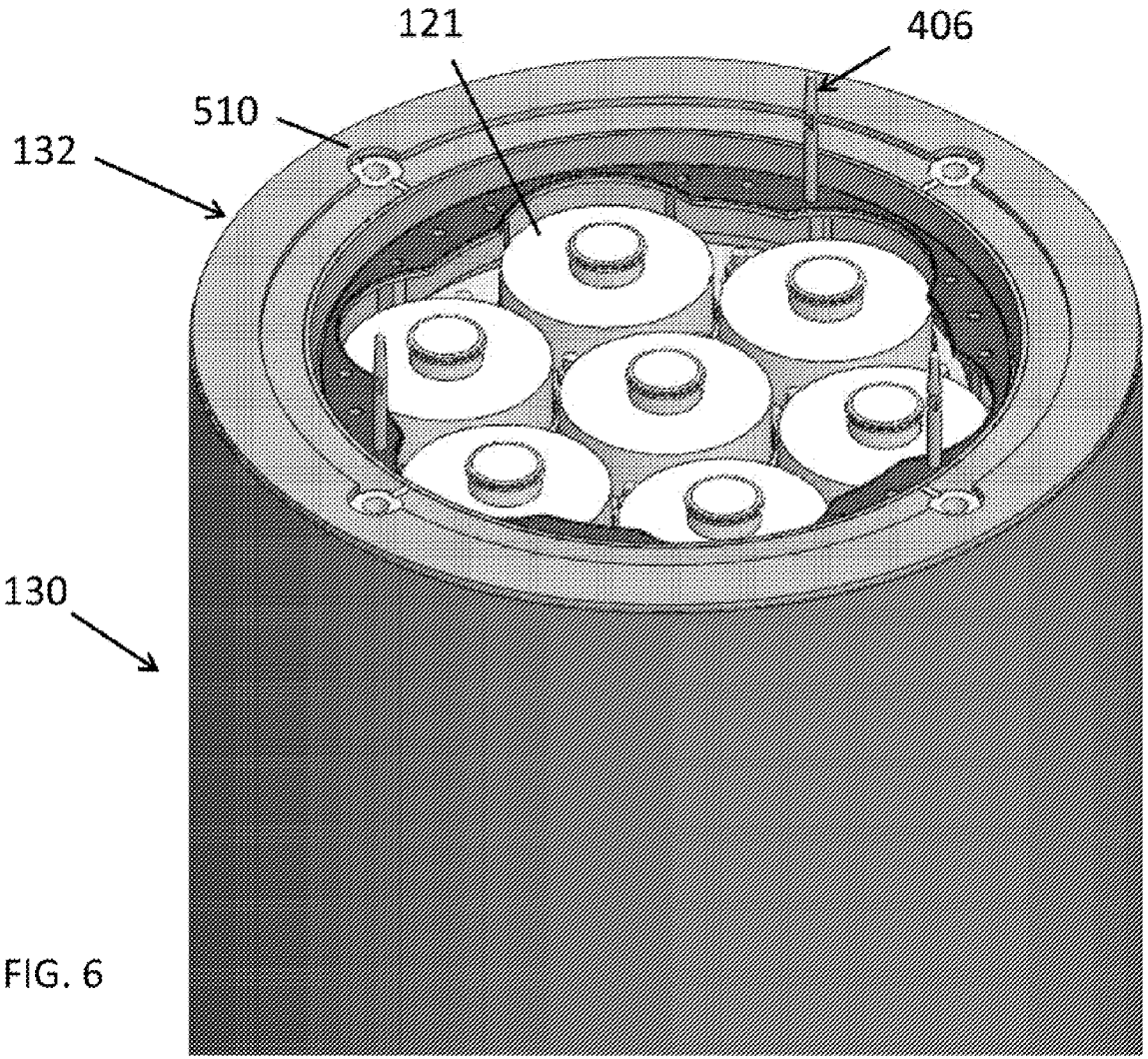
FIG. 6 is a perspective view thereof showing a plurality of waste cylinders installed in the basket insert of the canister.

Referring to FIG. 2, canister 100 has an interior configured to store the size and shape of radioactive waste to be deposited in the canister. In one embodiment, the canister may include a basket insert 120 configured for holding a plurality of metal waste cylinders 121 (see, e.g. FIG. 6) each containing radioactive waste materials. Basket insert 120 includes a pair of vertically spaced apart top and bottom plates 122, 124 which are connected via a plurality of tie rods 126. Top plate 122 and bottom plate 124 include a plurality of horizontally spaced apart circular openings 123 each having a diameter which is configured and dimensioned to receive waste cylinders 121 therethrough, as shown in FIG. 6.

Figure 3:
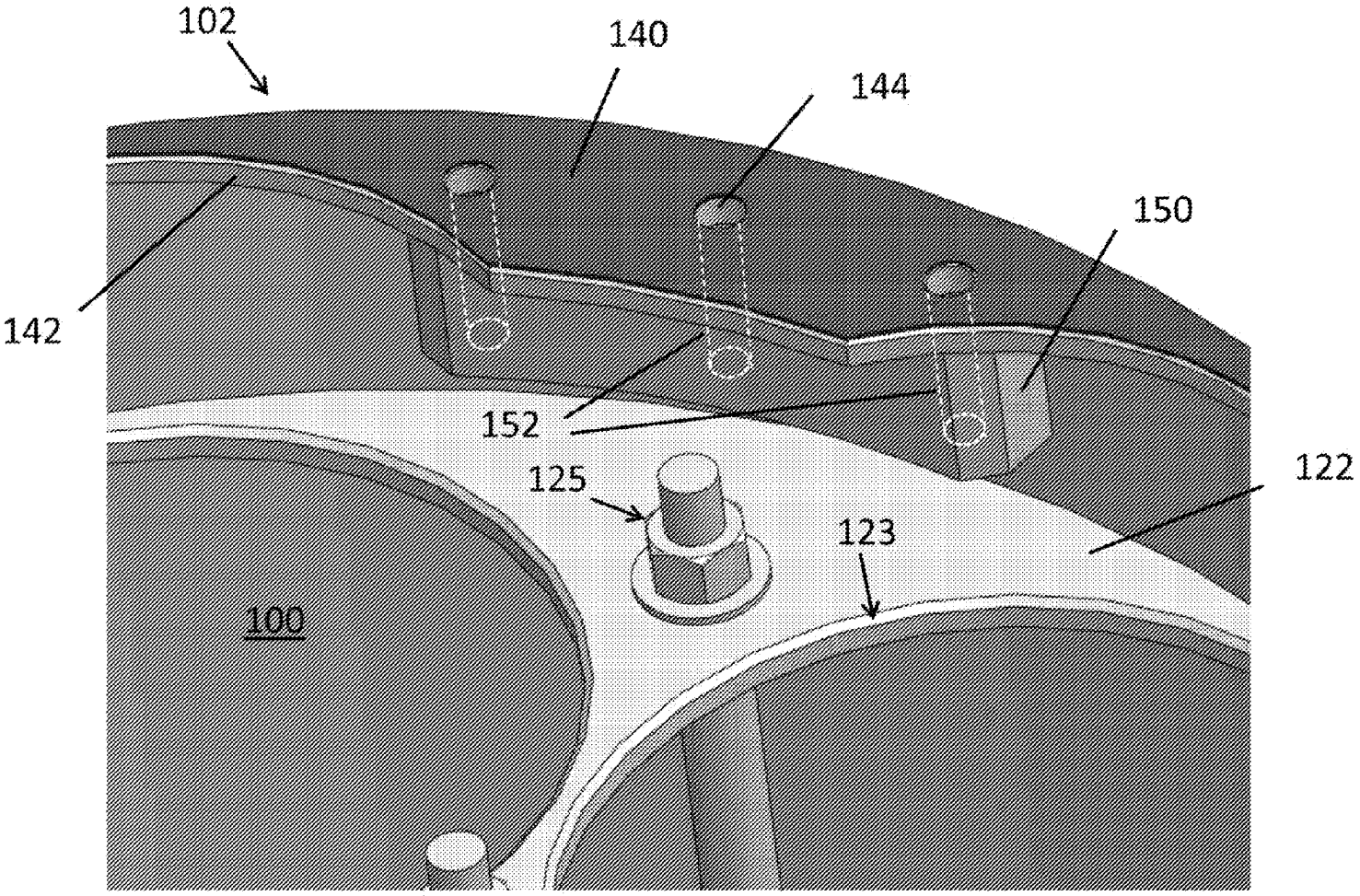
FIG. 3 is a close-up view thereof of the top portion of the canister showing details of the basket insert, a radiation containment barrier, and a bolting block.
Figure 4:
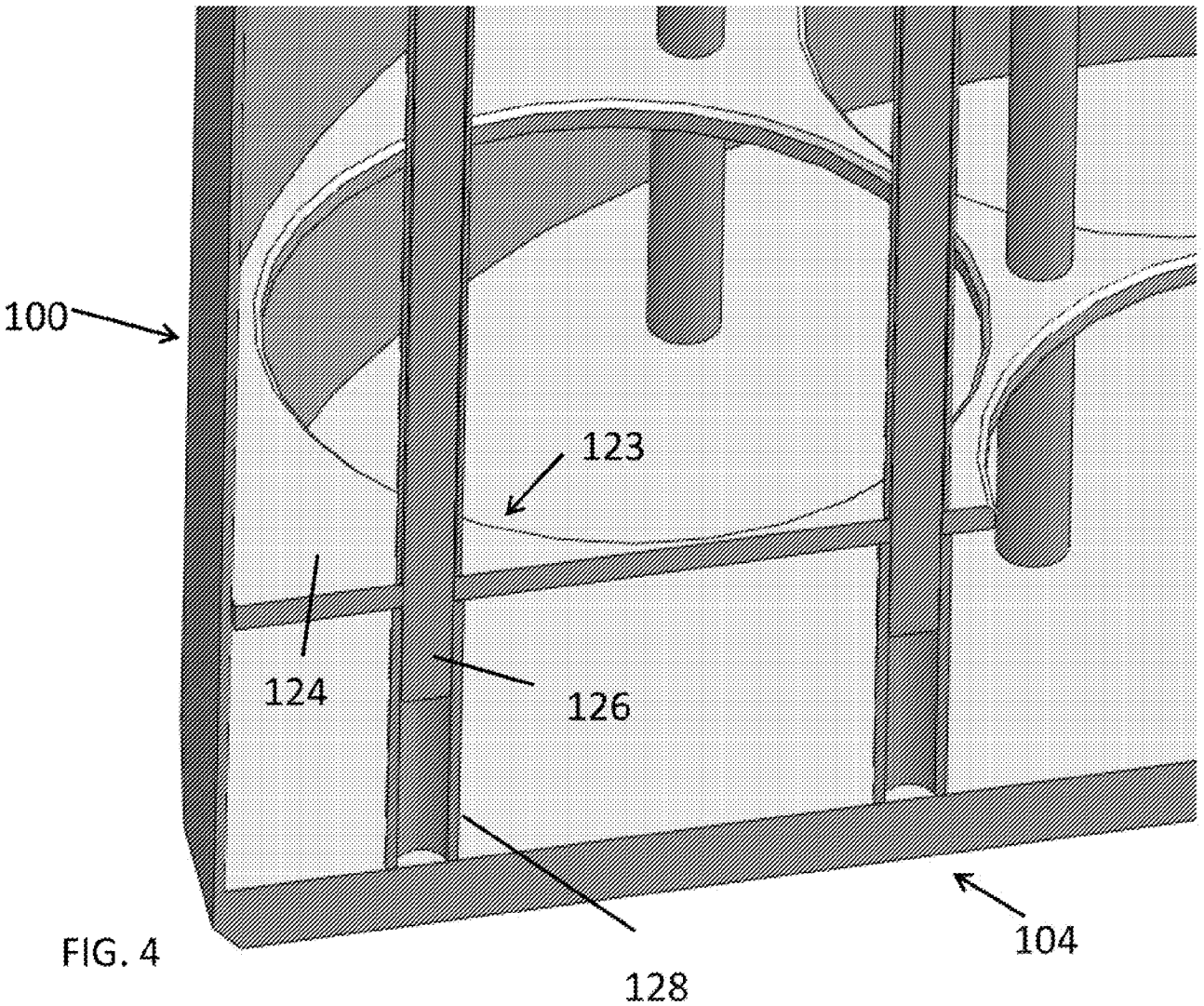
FIG. 4 is a close-up view thereof of the bottom portion of the canister showing details of the basket insert.

Referring to FIGS. 2 and 3, the top portion of tie rods 126 may be threaded for attachment to top plate 122 by a threaded nut 125. Top plate 122 may be spaced by a vertical distance below the top 102 of canister 100. Bottom plate 124 may be elevated by a vertical distance above the bottom 104 of canister 100 by a plurality of vertical tubular sleeves 128 having a bottom end resting on bottom 104 of the canister 100 and a top end attached to bottom plate 124 as better shown in FIG. 4. In one embodiment, sleeves have an inside diameter sized to receive the bottom end portion of tie rods 126 which are slidably received in the sleeves. This provides for vertical adjustment in the height of the basket insert 120 to accommodate the height of waste cylinders 121 to be stored inside canister 100. Bottom plate 124 remains fixed and stationary in position. The top plate 122 with attached tie rods 126, however, is movable upwards and downwards with respect to the canister and bottom plate 124 to reach a desired position depending on the height of waste cylinders 121. In some embodiments, the top plate 122 may be thereafter be fixed in the desired position after vertical adjustments are made by securing the top plate to the interior of the canister sidewall 106 such as by welding or other suitable means. Accordingly, adjustable basket insert 120 may accommodate a variety of waste cylinder heights.

Basket insert 120 (i.e. top plate, bottom plate, tie rods, etc.) may be made of any suitable material, including without limitation a corrosion resistant metal such as stainless steel in one embodiment.

Figure 5:
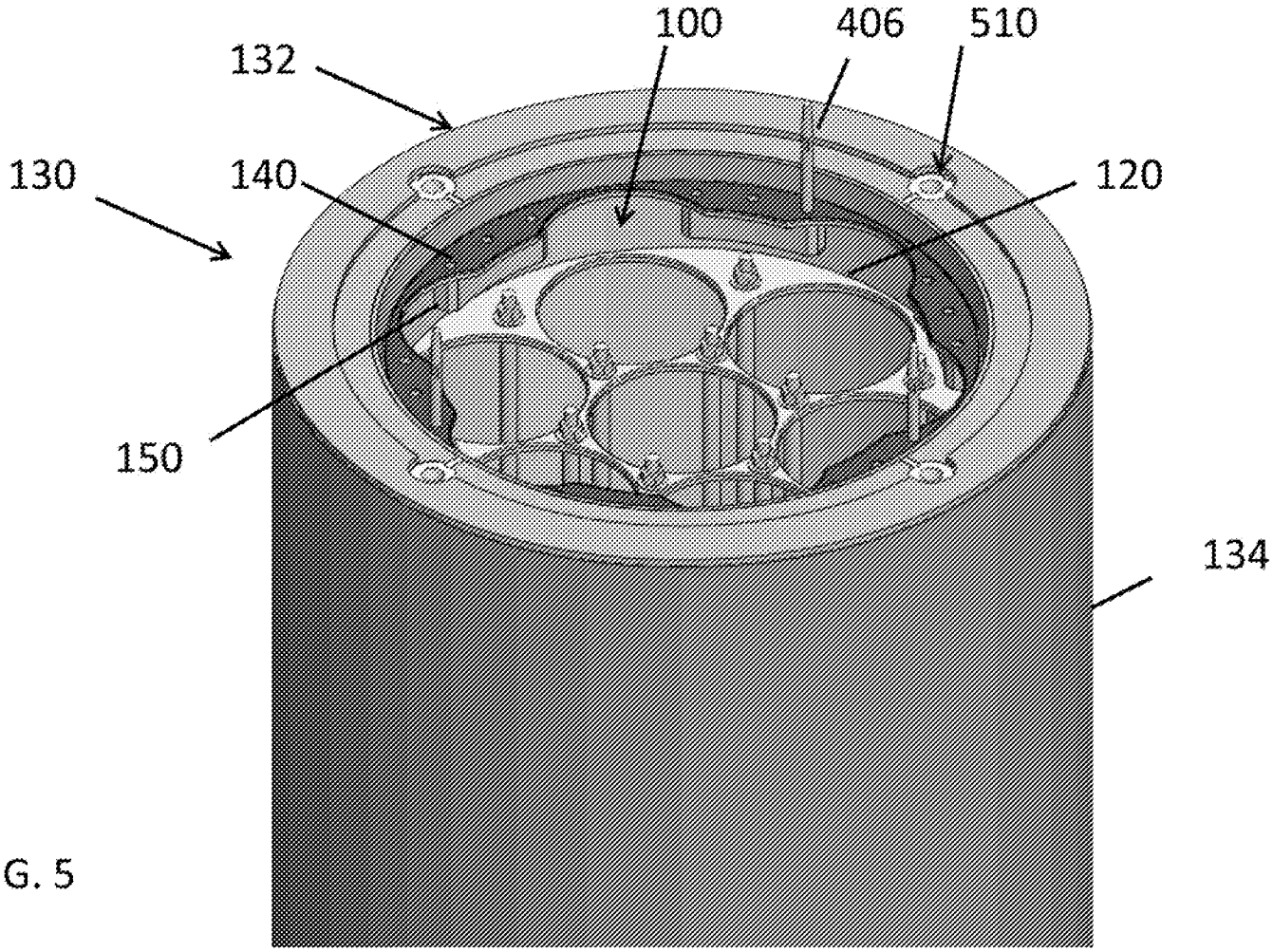
FIG. 5 is a perspective view of the canister of FIG. 1 disposed inside a protective overpack.

FIG. 5 shows canister 100 loaded into an outer overpack 130 for transport and storage of radioactive waste. The overpack provides protection during transport and storage of the waste by encapsulating the waste canister in an outer protective jacket. Overpack 130 has an open top 132, and is configured and dimensioned to completely receive canister 100 through the top 102. Overpack 130 has an open interior defining an interior surface 133 and an exterior surface 135 (see also FIG. 9). Overpack 130 is generally cylindrical in shape further including a cylindrical sidewall 134 and flat closed bottom 136 (see FIG. 15) configured for resting on a flat surface such as concrete slab. Preferably, in one embodiment, overpack 130 has a greater height than canister 100 so that the canister is recessed below the open top 132 of the overpack when fully inserted therein.

Overpack 130 may be made of any suitable material or combination of materials (see, e.g. FIG. 9) which may include neutron absorbing materials such as without limitation concrete, lead, or boron. An example of a suitable overpack for use with canister 100 may be a HI-SAFE™ transport overpack as used in vertical non-fuel waste storage systems available from Holtec International of Marlton, N.J. The sidewalls 134 forming the spaced apart cylindrical walls that define an annular space between the inner and outer surfaces 133 and 135 respectively may be formed of a corrosion resistant metal also selected for strength to protect the inner canister 100, such as stainless steel as one non-limiting example. The neutron absorbing material may be disposed between the inner and outer surfaces 133 and 135. In some embodiments, overpack 130 may also include Metamic® for radiation shielding which is a discontinuously reinforced aluminum/boron carbide metal matrix composite material also available from Holtec International.

Referring to FIGS. 2-3 and 5, the top of the canister 100 may include a peripheral contamination boundary seal which cooperates with the confinement lid 200 to prevent leakage of radiation from the canister, particularly at the lid bolting locations. In particular, the boundary seal shields the mounting blocks 150 to prevent radiation streaming.

In one embodiment, the boundary seal may be configured as an annular shielding flange 140 that extends circumferentially around the upper peripheral edge of the top 102 of the canister. Confinement lid 200 rests on the shielding flange when bolted to the canister 100. Shielding flange 140 may be horizontally flat and extend inwards in a direction perpendicular to and from sidewall 106 towards the vertical axial centerline CL of the canister 100. In one embodiment, shielding flange 140 is attached to the uppermost top edge of the sidewall 106 as shown. Shielding flange 140 may have an at least partially scalloped configuration in top plan view in some embodiments as shown to accommodate insertion of waste cylinders 121 into the canister. According, the scallops 142 if provided are preferably concentrically aligned with the circular openings 123 in basket insert 120 in top plan view. This minimizes the required diameter of the canister 100 for holding the waste cylinders 121. In other possible embodiments, however, shielding flange 140 may have an uninterrupted shape forming a continuous ring in top plan view.

At the lid bolting locations, shielding flange 140 is configured to cover a with a plurality of mounting blocks 150 which are circumferentially spaced around the interior of canister 100 disposed adjacent to sidewall 106 to provide a radiation-shielded bolting system for attaching confinement lid 200 and shielded lifting lid 300 to the canister. Shielding flange 140 may be formed of any suitable material including metals which are corrosion resistant such as stainless steel.

With continuing reference to FIGS. 2-3 and 5, mounting blocks 150 may have a generally arcuate and curved shape in top plan view which complements the inside radius of curvature of the sidewall 106 to which mounting blocks 150 may be attached. Mounting blocks 150 may be rigidly/fixedly attached to the canister sidewall 106 by a suitably strong mechanical connection capable of supporting at least the entire dead weight of canister 100 and basket insert 120 for lifting and loading the canister into overpack 130. Accordingly, in one preferred embodiment, mounting blocks 150 are welded to at least sidewall 106 of the canister body for strength. In some embodiments, the mounting blocks 150 may be abutted against but are not fixedly connected to the underside of radiation shielding flange 140 so that lifting loads are not transferred to the flange directly but rather bypass the flange to the mounting blocks 150 via the bolting provided.

Any suitable number of mounting blocks 150 may be provided; the number and circumferential spacing being dependent on the magnitude of the structural load imparted to the blocks dependent on whether the canister 100 will be lifted in an empty condition or in a fully loaded condition with filled waste cylinders 121 positioned in the canister. It is well within the ambit of those skilled in the art to determine an appropriate number and circumferential spacing of the mounting blocks 150.

Figure 9:
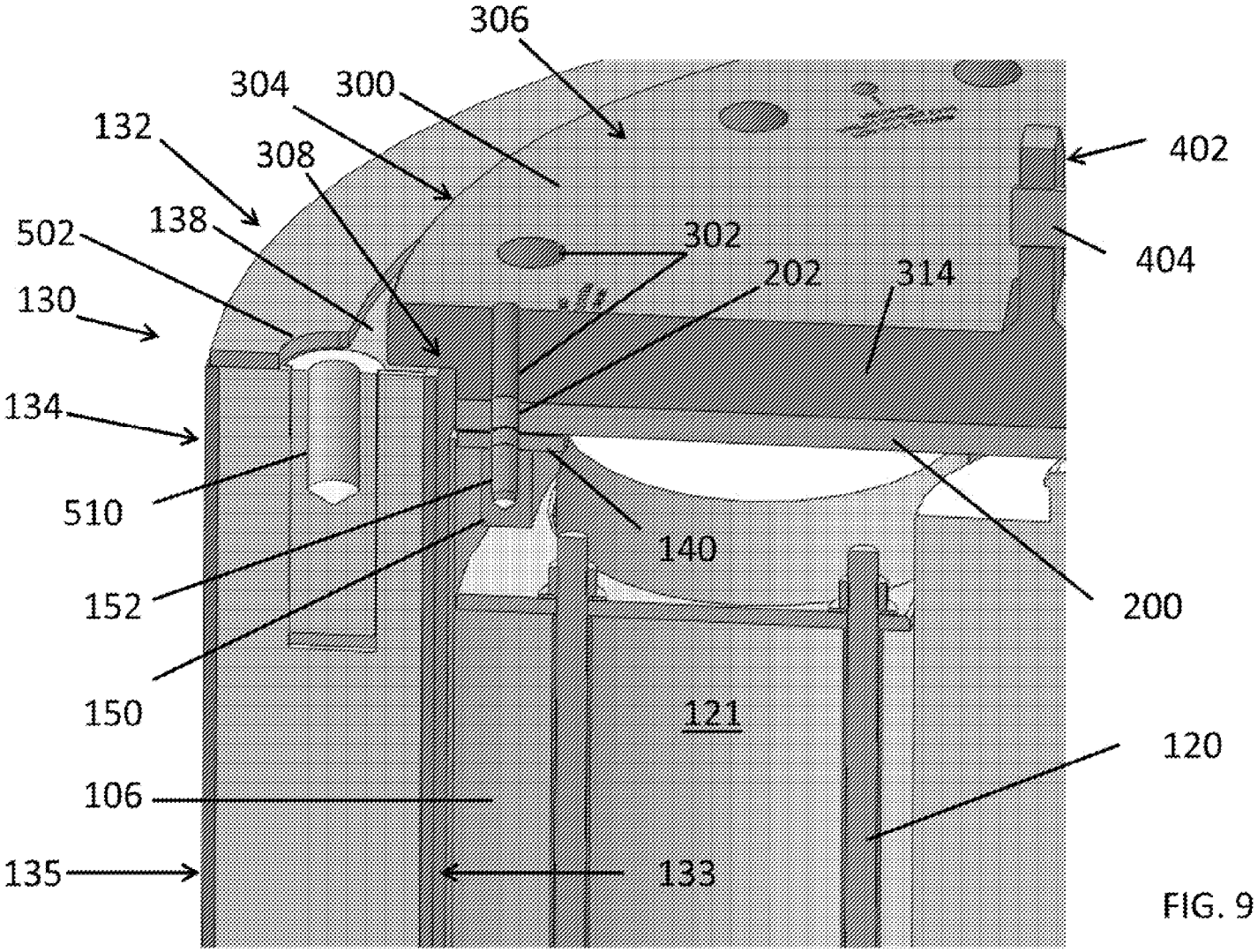
FIG. 9 is a cross-sectional perspective view thereof of the upper left corner portion of the overpack and canister.

In one embodiment, the mounting blocks 150 are each configured for both lifting canister 100 and attaching both the lower confinement lid 200 and upper lifting lid 300. As best shown in FIGS. 3 and 9, mounting blocks 150 each include a plurality of threaded mounting sockets 152 for forming a threaded connection with complementary threaded mounting bolts 154 and 156 used for attaching confinement lid 200 and shielded lifting lid 300 respectively to the canister 100. In one non-limiting example, three threaded mounting sockets 152 may be provided in each mounting block. However, other suitable numbers of mounting sockets may be used. In certain embodiments, the mounting sockets 152 extend only partially into the mounting blocks 150 as shown. Radiation shielding flange 140 includes mating holes 144 which are each concentrically aligned with the threaded mounting sockets 152 of the mounting block to provide access for mounting bolts 154, 156 to the mounting sockets in the block. Because shielding flange 140 in some embodiments in not intended to be a load-bearing member relied upon for lifting the canister, holes 144 may not be threaded so that the weight of the canister is transferred through the flange via the mounting bolts 156 to the shielded lifting lid 300.

Figure 11:
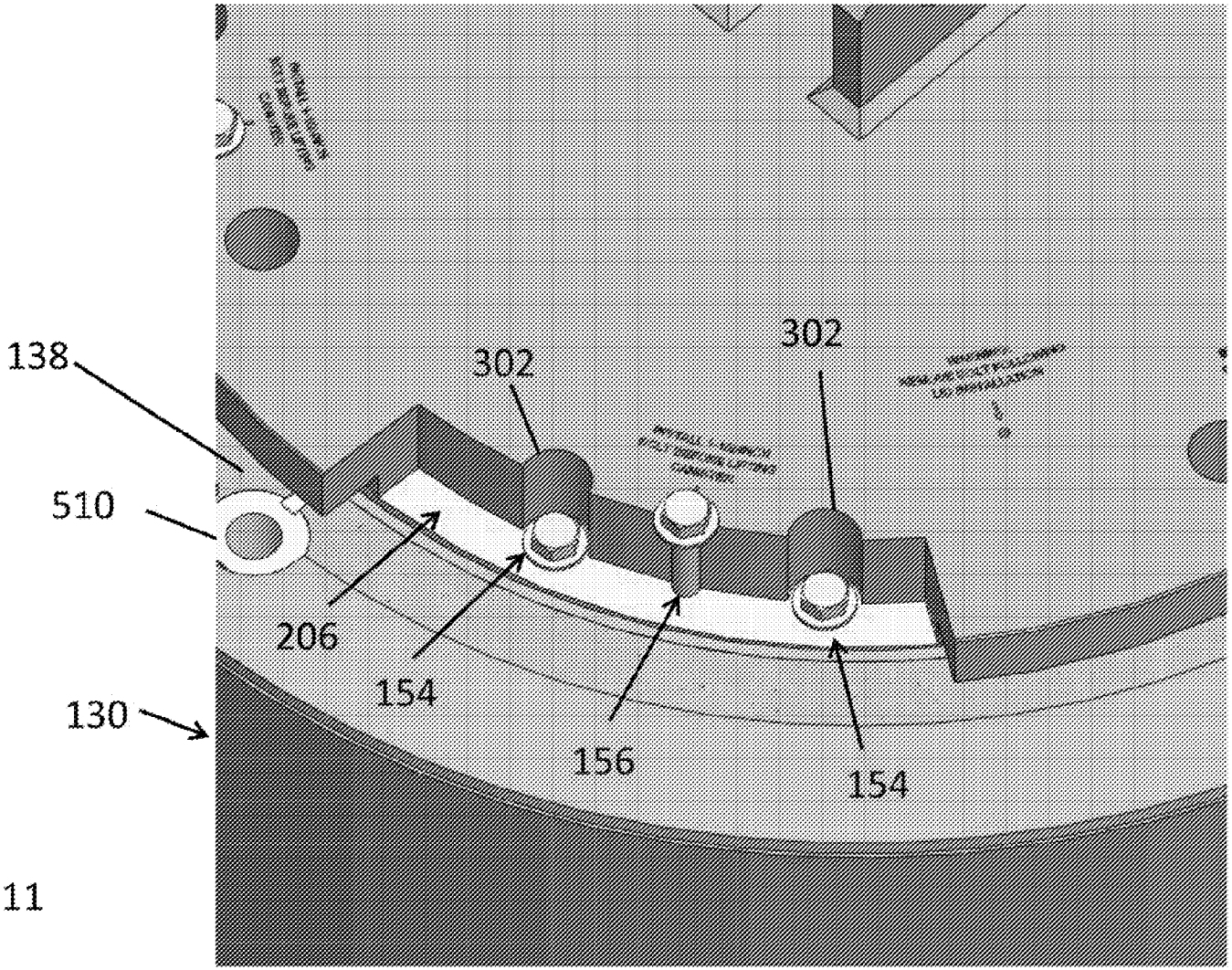
FIG. 11 is a close-up perspective view thereof with a portion of the shielded lifting lid being shown cutaway to show details of the confinement lid and shielded lifting lid bolting arrangement.
Figure 12:
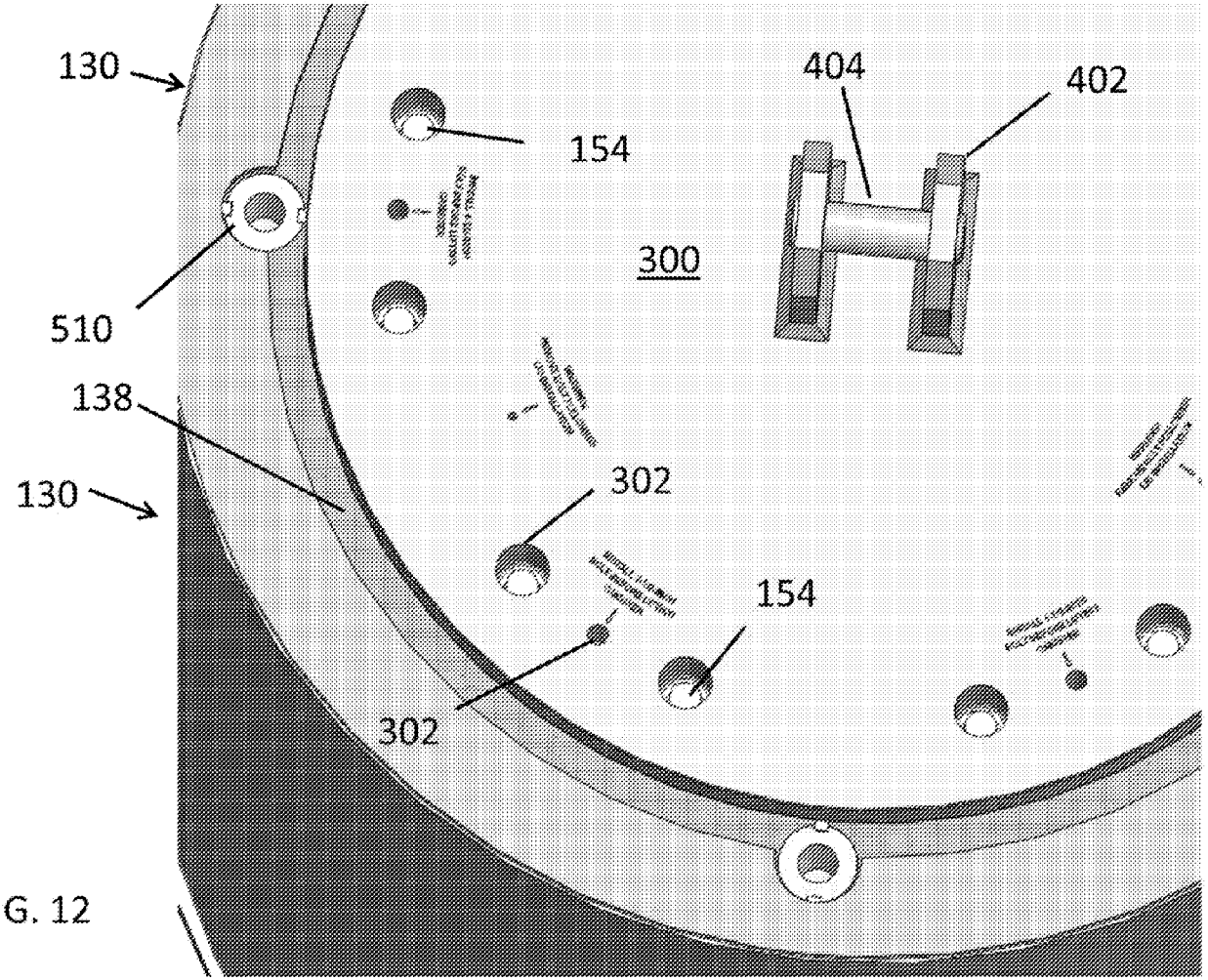
FIG. 12 is a perspective view thereof showing confinement lid mounting bolts in place.

In one embodiment, mounting bolts 154 and/or 156 may be threaded bolts having an integral or separate washer disposed adjacent to the head, as best shown in FIG. 11. Mounting bolts 154 are used for attaching the lower confinement lid 200 to canister 100 via mounting blocks 150. In one embodiment, mounting bolts 154 are not used for lifting the canister 100 but rather for lid securement. By contrast, mounting bolts 156 serve a dual purpose and may be used for both attaching the lower shielded lifting lid 300 to canister 100 and supporting the weight of the canister during lifting operations via mounting blocks 150 engaged by bolts 156. In one preferred embodiment, mounting bolts 156 may have a longer shank than mounting bolts 154 as shown. This arrangement ensures that the depth of threaded engagement between the threaded mounting sockets 152 of the mounting blocks 150 and mounting bolt 156 is sufficient for lifting the canister 100, as further explained herein.

The confinement lid 200 is generally circular in shape (top plan view) and shown in FIGS. 1, 9, and 11. Confinement lid 200 includes a plurality of bolt holes 202 spaced circumferentially around the peripheral side 204 of the lid as best shown in FIG. 1 (including at locations where mounting bolts 154 are shown installed). Bolt holes 202 penetrate top surface 206 of the confinement lid, and in one embodiment are not threaded. The bolt holes 202 may be arranged in groups corresponding to the location and arrangement of the mounting blocks 150 inside the canister 100. The bolt holes 202 have a diameter sized to at least pass the shank of mounting bolts 154 and 156 through the holes to threadably engage the mounting blocks 150. Accordingly, some of the bolt holes 202 are configured to receive the shanks of the confinement lid mounting bolts 154 and others are configured to receive the shank of shielded lifting lid mounting bolts 156. In cases where the mounting bolts 154 and 156 have shanks of the same diameter, the bolt holes 202 may all have the same diameter. Where the shanks of bolts 154 and 156 are different in diameter, the holes 202 may have correspondingly different diameters for each bolt.

The confinement lid 200 may have a uniform thickness from peripheral side 204 to peripheral side 204 as best shown in FIG. 9 in one embodiment. In other embodiments, the thickness may vary at different locations on the lid 200. Confinement lid 200 may be made of any suitable material, preferably an appropriate metal for the application. In an exemplary embodiment, without limitation, the confinement lid 200 for example may be made of stainless steel for corrosion resistance.

The upper shielded lifting lid 300 is not intended to remain on canister 100 for longer term waste storage. Instead, in some embodiments, the lifting lid 300 is configured and structured for transporting and initially lifting the canister 100 into position in the cylindrical overpack 130 prior to loading the waste cylinders 121 after which the lifting lid is removed, and then after the waste cylinders are loaded in the canister, the lifting lid is replaced on the canister to shield the operator for bolting the lower confinement lid 200 in place after which the lifting lid is removed again. It will be appreciated that this scenario for using the shielded lifting lid 300 may be varied in other embodiments.

Referring to FIGS. 7-12, shielded lifting lid 300 is generally circular in shape (top plan view) and includes a plurality of bolt holes 302 spaced circumferentially around the peripheral side 304 of the lid as best shown in FIG. 1. In one embodiment, holes 302 are not threaded. The bolt holes 302 may be arranged in clustered groups or sets corresponding to the location and arrangement of the mounting blocks 150 inside the canister 100. The bolt holes 302 have a diameter sized to at least pass the shank of mounting bolts 154 and 156 through the holes to threadably engage the mounting blocks 150. Accordingly, some of the bolt holes 302 are configured to receive the shanks of the confinement lid mounting bolts 154 and others are configured to receive the shank of shielded lifting lid mounting bolts 156. In cases where the mounting bolts 154 and 156 have shanks of the same diameter, the bolt holes 302 may all have the same diameter. Where the shanks of bolts 154 and 156 are different in diameter, the holes 302 may have correspondingly different diameters for each bolt.

According to another aspect of the invention, bolt holes 302 have different diameters in one embodiment even if the mounting bolts 154, 156 are used have the same shank diameter. The confinement lid mounting bolts 154 need not engage the upper shielded lifting lid because bolts 154 are only required to secure the lower confinement lid to canister 100. Accordingly, in the embodiment shown in FIG. 11, the bolt holes 302 for the confinement lid mounting bolts 154 may have a larger diameter than the bolt holes 302 for the lifting lid mounting bolts 156. In this arrangement, the bolt holes 302 for the confinement lid mounting bolts 154 are sized with a diameter large enough to allow the shank and entire head of bolts 154 to pass through the bolt holes so that the head and integral washer directly engage the top surface 206 of the confinement lid 200 (see, e.g. FIG. 1). When completely installed, the heads of the mounting bolts 154 are recessed below the top surface of the lifting lid 300 as shown.

By contrast, since the mounting bolts 156 for the lifting lid 300 also serve a lifting function for the canister 100, the bolt holes 302 have a diameter sized so that the heads of bolts 156 do not pass through the bolt holes and instead engage the top surface 306 of the lifting lid (thereby projecting above the top surface and remaining exposed as shown in FIG. 11). In this manner, the bolts 156 transfer the dead load and weight of the canister 100 from the mounting blocks 150 directly to the shielded lifting lid 300 without involvement of the confinement lid 200. Accordingly, to accommodate the foregoing arrangement, the lifting lid mounting bolts 156 preferably have a longer shank than the confinement lid mounting bolts 154 in this embodiment.

Figure 10:
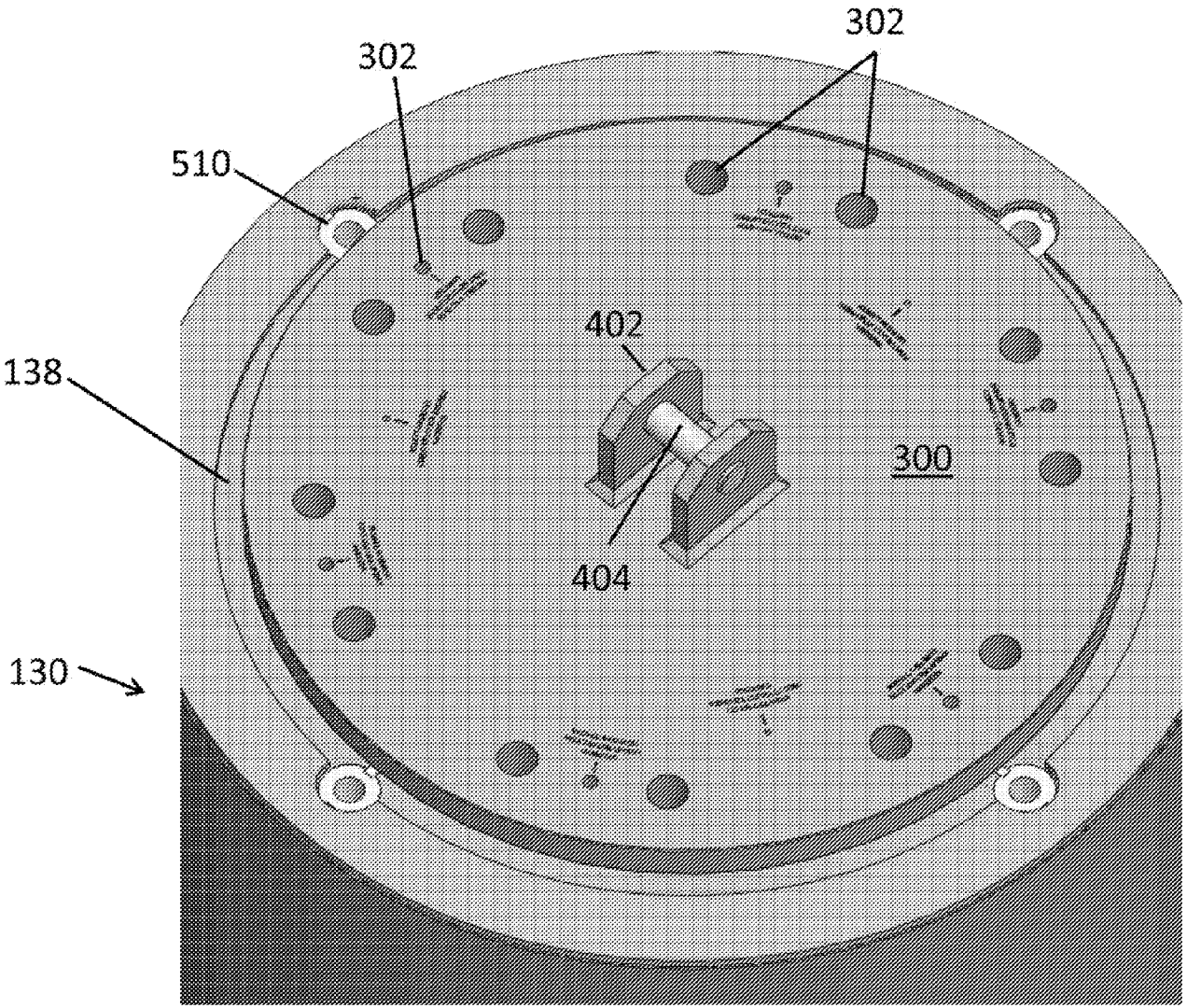
FIG. 10 is a top perspective view of the overpack showing the confinement lid-shielded lifting lid positioned on the overpack.

As shown in FIGS. 9 and 10, several spaced apart clusters comprised of three bolt holes 302 may be provided in the non-limiting embodiment shown which are spaced circumferentially around and proximate to the peripheral side 304 of the shielded lifting lid 300. Each cluster of bolt holes 302 is spaced apart by an arcuate distance from adjacent clusters of holes 302. The clusters of bolts holes 302 are each vertically aligned with a corresponding mounting block 150 (see also FIG. 3). In this embodiment, the center hole 302 has a smaller diameter for the lifting lid mounting bolt 156 than the two adjacent outer holes 302 have larger diameters for the confinement lid mounting bolts 154. Other suitable arrangements of holes 302 may be provided. The bolt holes 202 in the confinement lid 200 may also arranged in clusters of three to mate with the bolt holes 302 of the lifting lid 300. All three of the bolt holes 202 in each cluster in the confinement lid, however, may have the same diameter.

Advantageously, having two different size bolt holes 302 for the confinement lid mounting bolts 154 and the lifting lid mounting bolts 156 reduces possible installation error and ensures that the operator will not confuse which holes are intended for each. This plays a role in deploying the two-part lid system when the confinement lid 200 and its respective bolts 154 are eventually left in place after bolting the confinement lid to the canister 100 and the lifting lid mounting bolts 156 are removed by the operator, as further described herein.

The shielded lifting lid 300 may have a non-uniform thickness from peripheral side 304 to peripheral side 304 as best shown in FIG. 9. Accordingly, in one possible embodiment as shown, the peripheral portion of lifting lid 300 may include an outer annular step or shoulder 308 having a smaller thickness than the inner central portion 314 of the lid. The shoulder 308 is configured to complement and abuttingly engage a corresponding top annular rim 138 of the overpack 130 such that portions of the lifting lid 300 adjacent to peripheral side 304 overlap the top of the rim to prevent radiation streaming as shown. Rim 138 therefore defines an annulus for receiving shoulder 308. Accordingly, as shown in FIG. 9, shielded lifting lid 300 has a larger diameter than confinement lid 200 to account for the overlap with the annular rim 138 of the overpack 130.

The central portion 314 of the lifting lid 300 preferably has a thickness and a diameter sized to allow at least partial insertion of the central portion into the overpack 130 such that the outwards facing annular sides of the central portion abuts the interior surface 133 of the overpack as shown. This arrangement further prevents radiation streaming from the canister 100 when the lifting lid 300 is in place on the canister.

Because shielded lifting lid 300 serves a structural purpose for lifting the canister 100, the lifting lid preferably has a thickness which is greater than the confinement lid 200. In one embodiment, the lifting lid has a thickness which is at least twice the thickness of the confinement lid. Shielded lifting lid 300 may be made of any suitable material, preferably an appropriate metal for the application. In exemplary embodiments, without limitation, the lifting lid 300 for example may be made of carbon steel or stainless steel.

Figure 7:
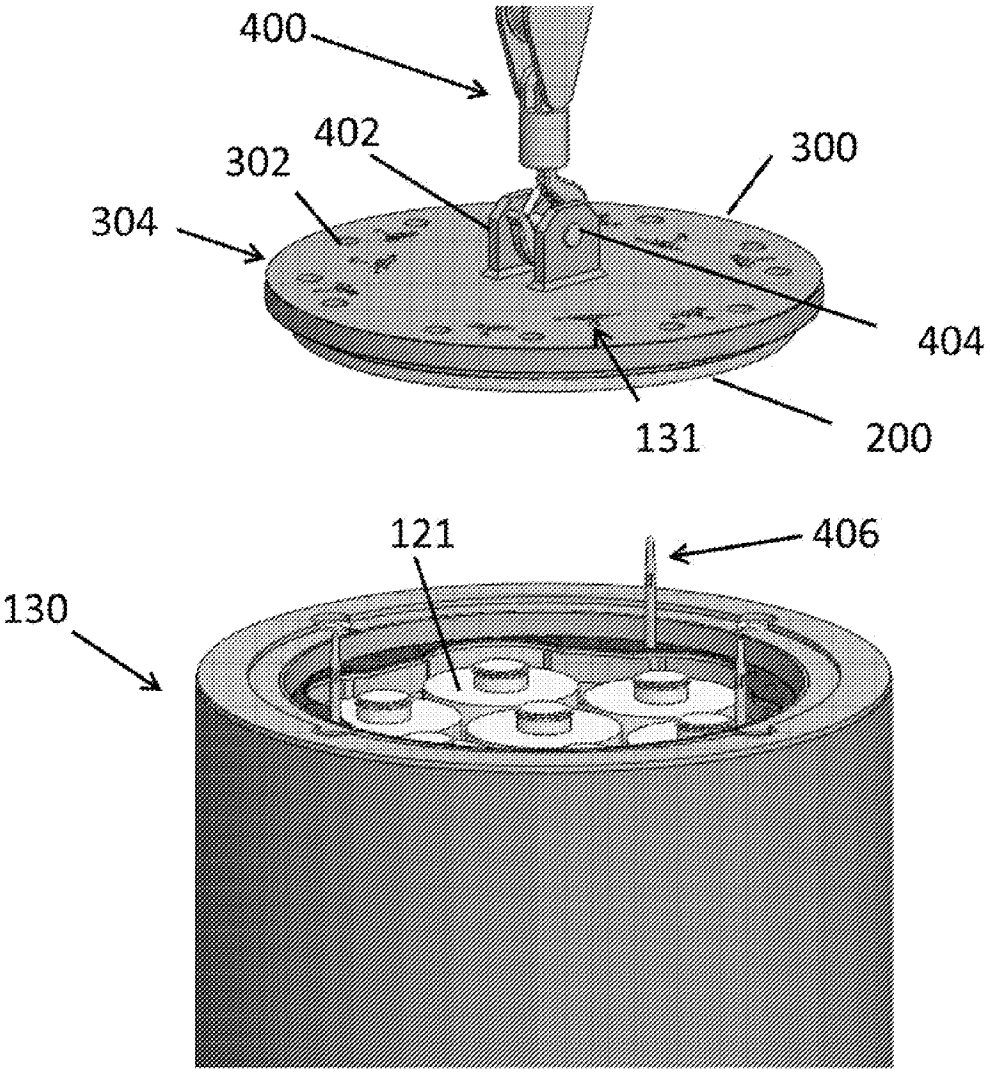
FIG. 7 is a perspective view thereof also showing a coupled confinement lid-shielded lifting lid assembly being grappled and hoisted over the overpack and canister.
Figure 8:
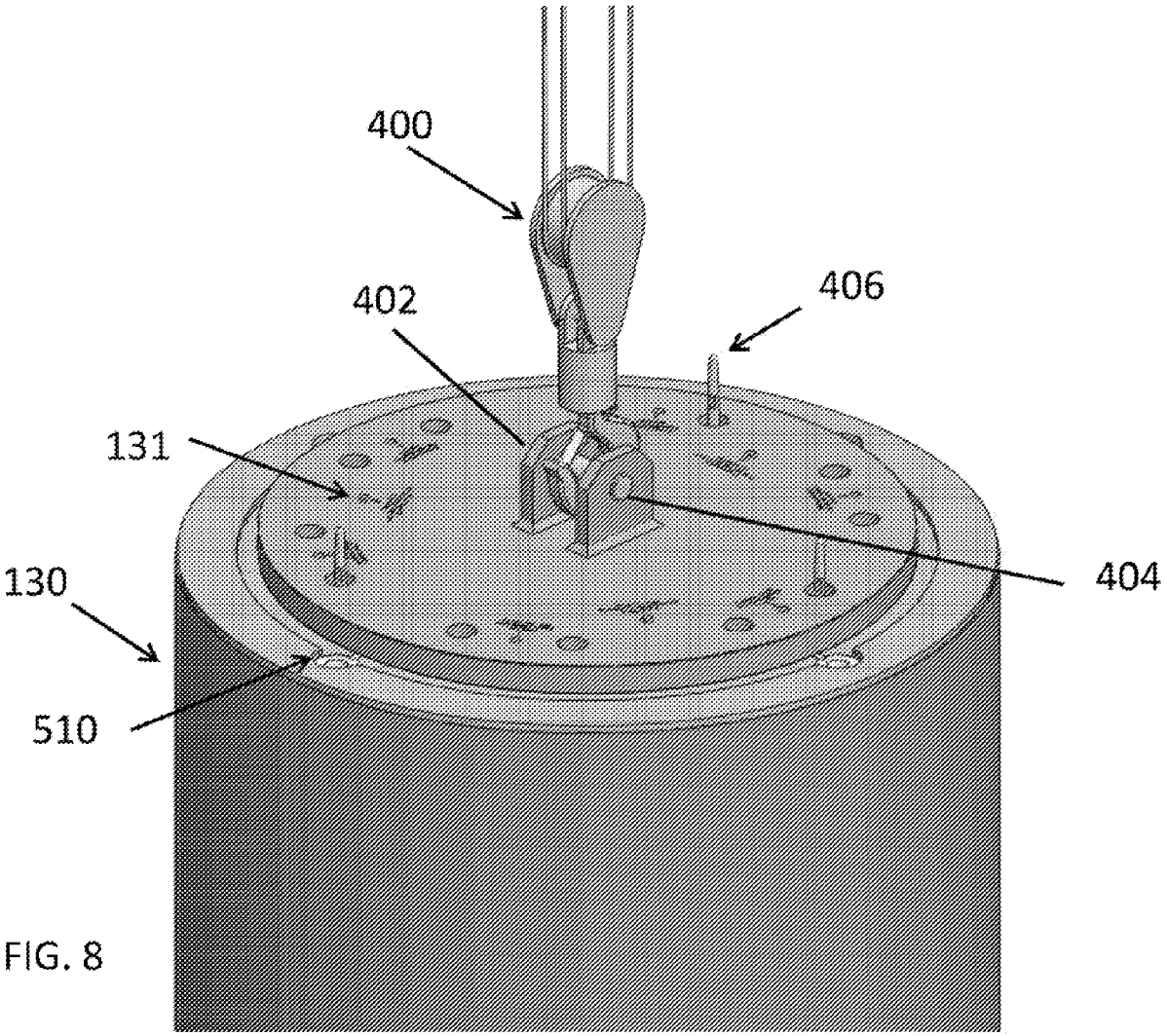
FIG. 8 is a perspective view thereof showing the grappled confinement lid-shielded lifting lid assembly lowered and placed in position on the overpack and canister.

Referring to FIGS. 7 and 8, the lower confinement lid 200 is detachably mounted to upper shielded lifting lid 300 so that the lid assembly 200/300 may be lifted and moved as a single unit as shown with the lifting lid supporting the confinement lid when not attached to the canister 100. When needed during the canister closure operations, the lifting lid 300 may be uncoupled from the confinement lid 200. In one embodiment, a plurality of circumferentially spaced fasteners such as threaded assembly bolts 131 may be provided to attach lifting lid 300 to confinement lid 200. Assembly bolts 131 which are inserted through the lifting lid 300 and engage complementary threaded sockets 208 (shown in FIG. 1) formed in the confinement lid (such arrangement and operation being apparent to those skilled in the art without further elaboration). A suitable number of assembly bolts 131 are provided to support the lower confinement lid 200 from the upper shielded lifting lid 300 during hoisting. Accordingly, confinement lid 200 may be considered to be fully supported by the lifting lid 300 during lifting of the lid assembly 200/300.

As shown in FIGS. 7 and 8, shielded lifting lid 300 includes a lifting attachment such as lifting lugs 402 and pin 404 for grappling and hoisting the lid. Other suitable lifting attachments configured for grappling such as for example lifting bails may be used.

An exemplary method for storing radioactive waste using the present container system with two-part lid assembly 200/300 (confinement lid 200, lifting lid 300) according to the present disclosure will now be described. As a preliminary step, the lower confinement lid 200 is detachably mounted to the upper shielded lifting lid 300 using assembly bolts 131 to collectively form the lid assembly 200/300, shown in FIG. 7.

Referring to FIGS. 1 and 2, the method begins with a canister 100 first being provided with an empty basket insert 120 disposed inside the canister as shown. Next, the empty canister 100 is lifted and placed into the overpack 130 as shown in FIG. 5. In one embodiment, this step may be performed by bolting the lid assembly 200/300 to canister 100 using the mounting bolts 156 to threadably engage the mounting blocks 150, and grappling and attaching a hoist 400 to the upper lifting lid 300 using lifting lugs 402 and pin 404 as shown in FIG. 7. The hoist 400 may be part of the lifting equipment such as a crane or other suitable equipment operable to raise and lower the canister. After positioning the basket insert 120 into the canister 100, the mounting bolts 156 may be removed to disconnect the canister from the lid assembly. The lid assembly 200/300 may then be lifted by the hoist and removed (see FIG. 5).

Next, one or preferably more lid alignment pins 406 may be threaded into some of the threaded sockets 152 of the mounting block to eventually help properly align the lid assembly 200/300 with the canister (see FIG. 5). In one non-limiting example, three alignment pins 406 are used spaced apart on the canister. The alignment pins 406 are preferably installed locally by an operator prior to loading the radioactively "hot" waste cylinders 121 into the canister. Following installation of the alignment pins 406, the waste cylinders 121 are loaded into the canister 100, and more specifically positioned in their respective locations provided in basket insert 120 as shown in FIG. 6. Loading of the waste cylinders is performed remotely (i.e. at a distance) by an operator using suitable equipment to protect the operator from radiation.

After loading the waste cylinders 121, the lid assembly 200/300 is remotely hoisted by the operator over and vertically positioned above the top 102 of the canister 100, as shown in FIG. 7. Using the lid alignment pins 406, the operator vertically aligns holes 302 in shielded lifting lid (with holes 202 in confinement lid being concentrically aligned with holes 302) with corresponding pins 406 to properly orient the lid rotationally with respect to the canister. When the pins 406 and their corresponding holes have been axially aligned, the operator lowers lid assembly 200/300 onto the canister 100 as shown in FIG. 8 (see pins 406 extending through holes 302). The operator will now be shielded from radiation emitted from the canister so that the confinement lid 200 may be bolted in place locally.

Next, the lid alignment pins 406 and assembly bolts 131 which hold the lower confinement lid 200 to upper shielded lifting lid 300 may be removed (see, e.g. FIG. 10). All of the confinement lid mounting bolts 154 may then be installed to mount the confinement lid 200 to the canister 100 using the mounting blocks 150. The mounting bolts 154 are threaded through bolt holes 302 until the heads of the bolts engage the top surface 206 of the confinement lid 200 and the bolts are tightened to the required torque (see FIGS. 11 and 12).

Prior to removing the shielded lifting lid 300, a set of overpack lid alignment pins 408 may next be installed in threaded sockets 510 of the overpack 130.

Figure 15:
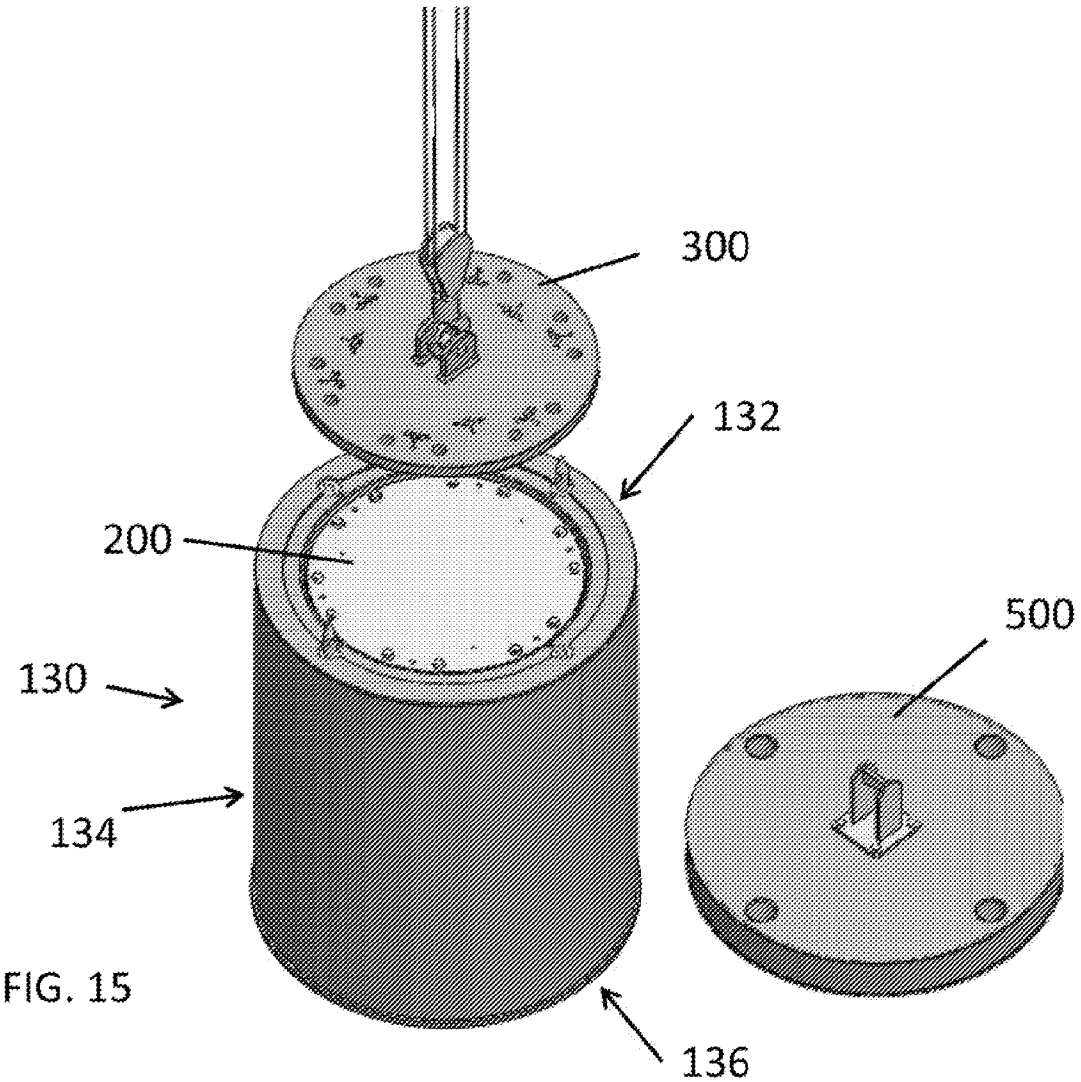
FIG. 15 is a perspective view of the grappled shielded lifting lid uncoupled from the confinement lid and being removed from the overpack and canister, with the overpack lid staged for installation.

With the confinement lid 200 now fully fastened to canister 100, the shielded lifting lid 300 may next be removed via the hoist remotely by an operator as shown in FIG. 15.

Figure 13:
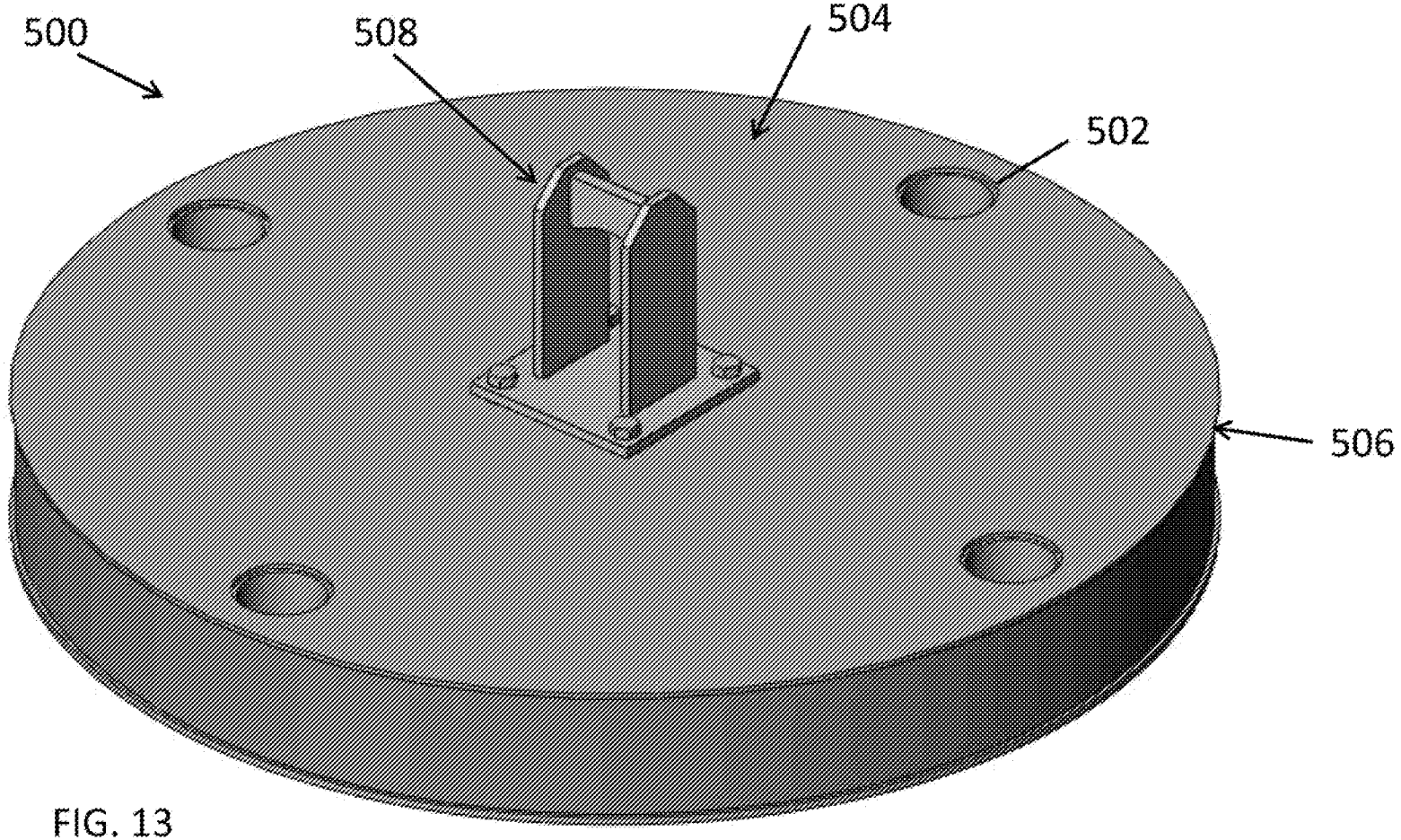
FIG. 13 is a perspective view of the overpack lid.
Figure 14:
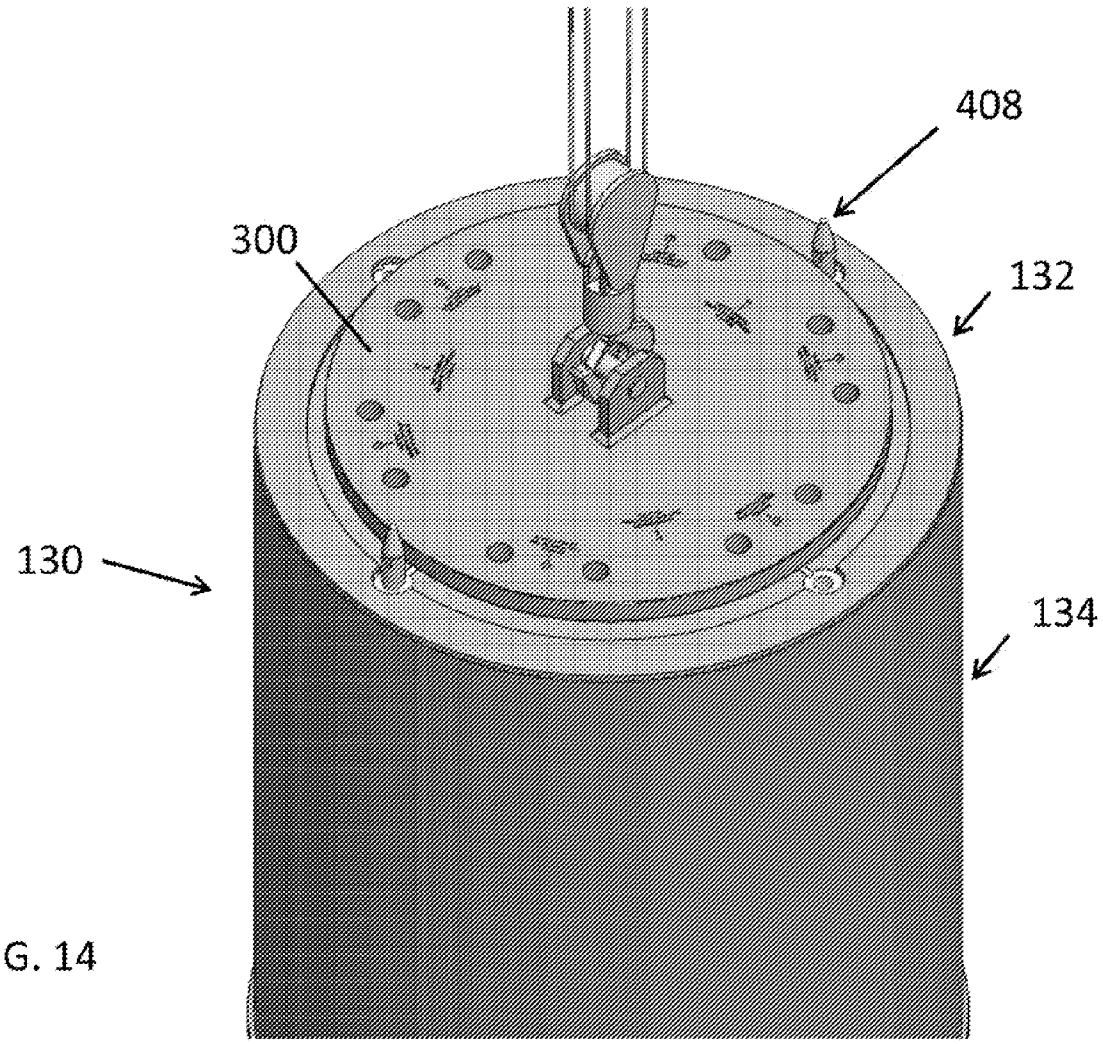
FIG. 14 is a perspective view thereof showing the confinement lid-shielded lifting lid assembly and overpack of FIG. 8 with overpack lid alignment pins in place.

In the following steps, the overpack lid 500 is installed on overpack 130 following closure of canister 100 described above. FIG. 15 shows the shielded lifting lid 300 being removed and the overpack lid 500 staged for installation. FIG. 13 shows overpack lid 500 in greater detail. Overpack lid 500 is circular in shape (top plan view) and includes a plurality of mounting holes 502, top surface 504, peripheral sides 506, and a lifting bail 508 attached towards the center of the lid for engagement by a hoist. Overpack lid 500 serves a structural role of protecting the canister 100 disposed inside the overpack 130, and in some embodiments supporting the weight of the overpack when mounted thereto for transport and lifting. Accordingly, overpack lid 500 may have a thickness greater than the thickness of the confinement lid 200.

Figure 16:
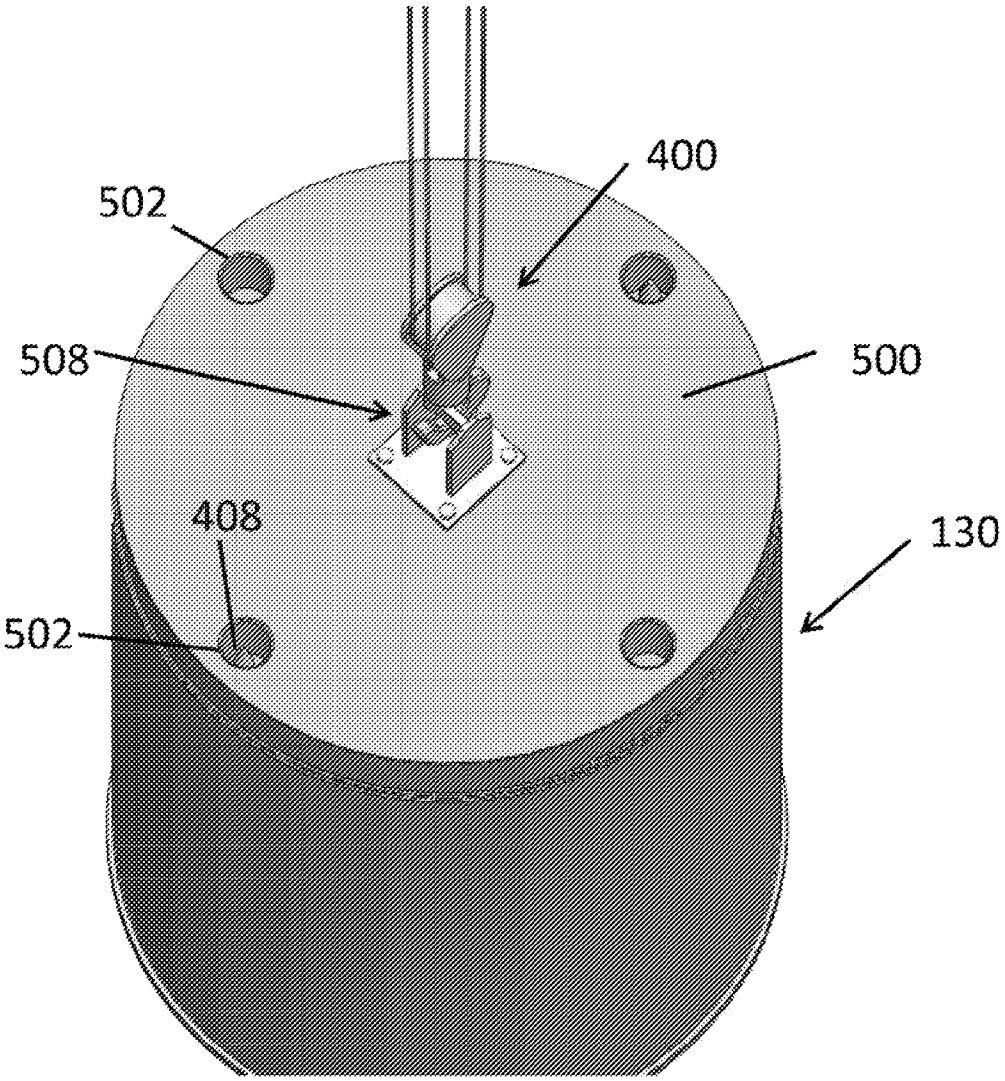
FIG. 16 is a perspective view of the grappled overpack lid lowered into position on the overpack.
Figure 17:
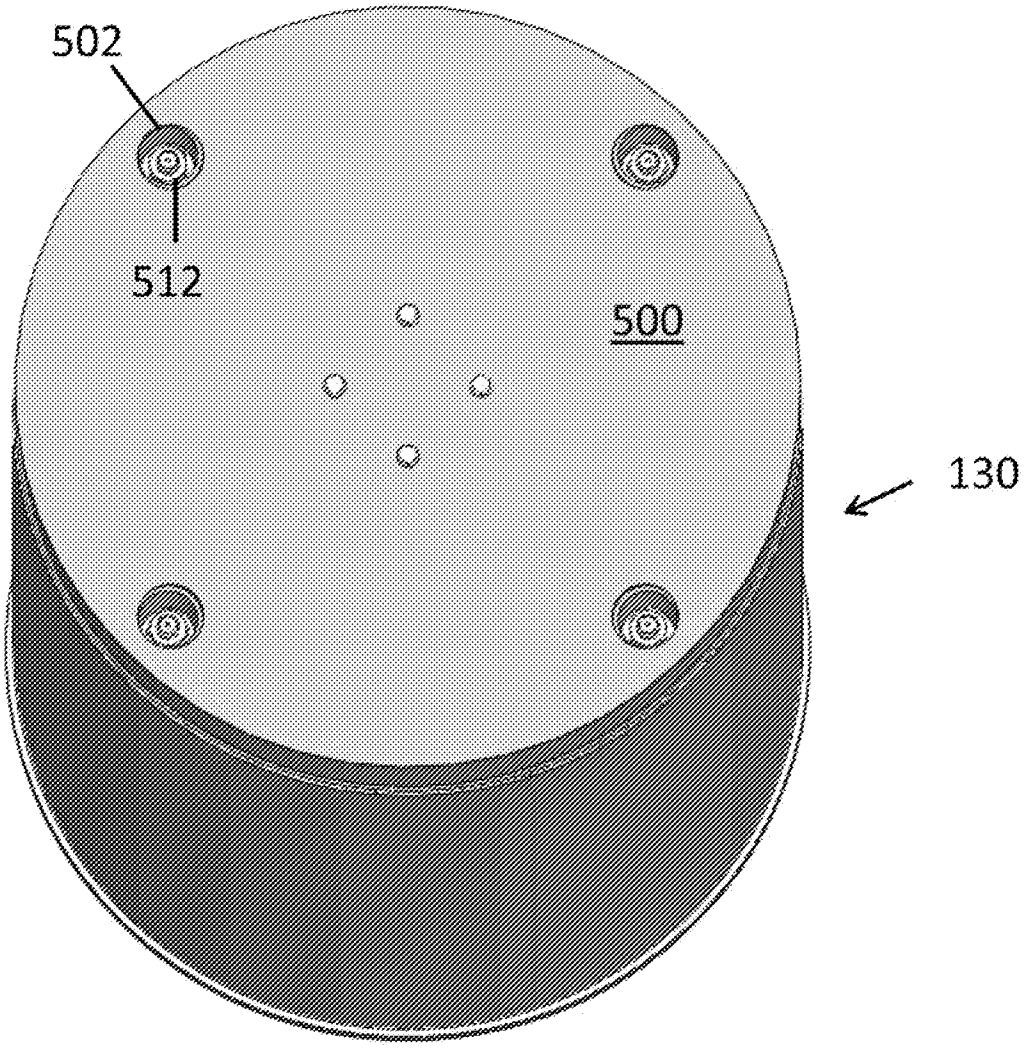
FIG. 17 is a perspective view thereof with the overpack lid bolted onto the overpack.

Referring now to FIGS. 15 and 16, the overpack lid 500 is grappled and lifted via the attached hoist 400 by crane or other equipment, vertically aligned with overpack 130 using the alignment pins 408 in a manner similar to alignment pins 406, and lowered onto the overpack. Alignment pins 408 are then removed and mounting bolts 512 are then installed in the threaded sockets 510 of the overpack 130 to complete installation and securement of the overpack lid 500, as shown in FIG. 17. Optionally, the lifting bail 508 may be removed.

Figure 18:
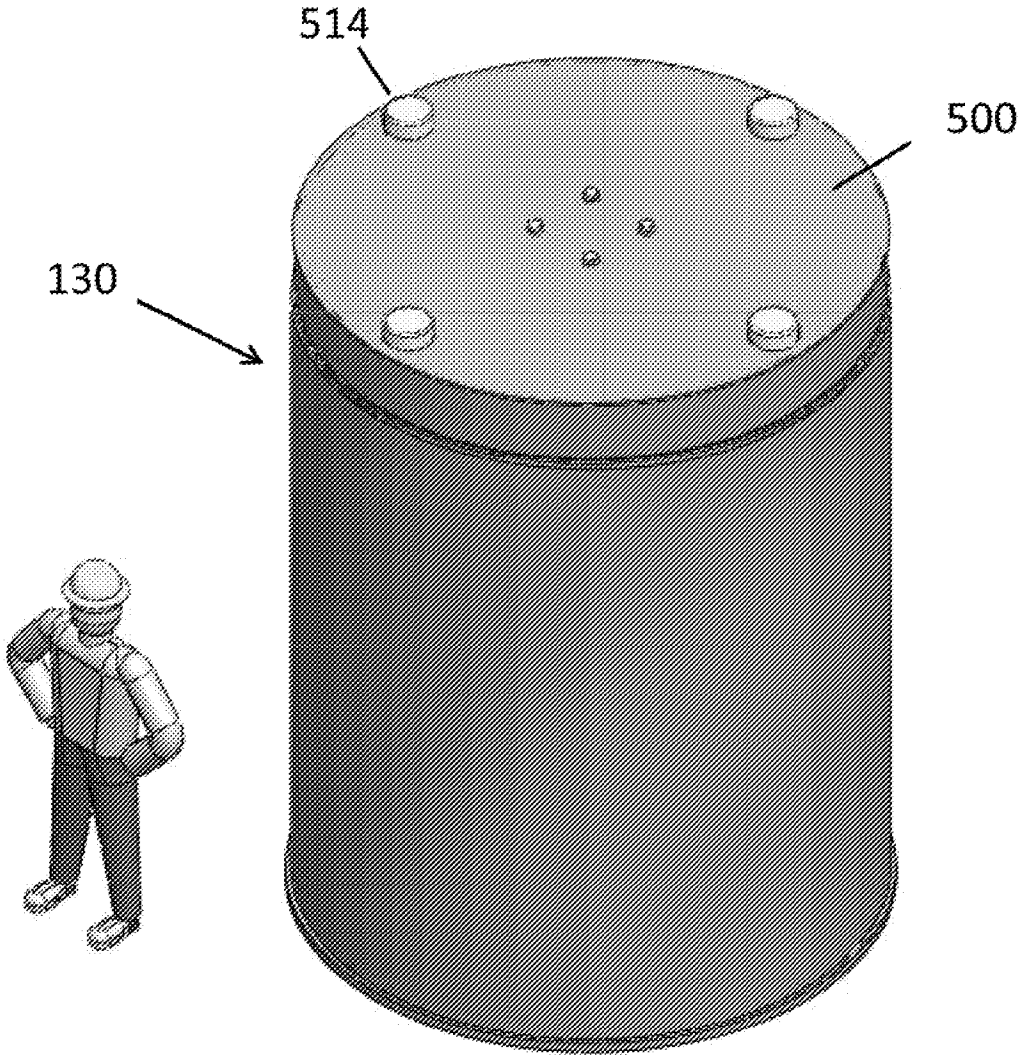
FIG. 18 is a perspective view of the fully assembled overpack.

FIG. 18 shows the overpack 130 with overpack lid 500 fully installed and canister 100 disposed inside loaded with waste cylinders 121. Protective caps 514 may be installed over mounting bolts 512. An operator is shown in FIG. 18 to provide perspective on the size of overpack 130 in one non-limiting embodiment, which may be about 6 or more feet in diameter and about 6 or more feet in height. Any suitable size overpack may be used.

As noted herein, the shielded lifting lid 300 is reusable. Accordingly, in some embodiments, the exemplary method described above may further comprise a step of detachably mounting a second different confinement lid 200 to the shielded lifting lid 300; the second confinement lid and shielded lifting lid collectively forming a second lid assembly.

It will be appreciated that the two-part lid assembly 200/300 may also be used in applications where the confinement lid 200 is intended to be welded to the canister 100 for closure rather than by bolting.

While the invention has been described and illustrated in sufficient detail that those skilled in this art can readily make and use it, various alternatives, modifications, and improvements should become readily apparent without departing from the spirit and scope of the invention.

What is claimed is:

1. A radioactive waste container system comprising:

a canister having an interior chamber for holding radioactive waste and an open top;

a lid assembly comprising a confinement lid and a shielded lifting lid, the confinement lid being detachably mounted to the shielded lifting lid;

the confinement lid being configured for mounting on the canister and having a first thickness;

the shielded lifting lid including a lifting attachment and having a second thickness;

wherein the confinement lid is independently mountable on the canister relative to the shielded lifting lid;

wherein the shielded lifting lid comprises a plurality of first bolt holes and the confinement lid comprises a plurality of second bolt holes, the first and second bolt holes concentrically aligned; and a plurality of first mounting bolts inserted through some of the first bolt in the shielded lifting lid and attaching the confinement lid to the canister without engaging the shielded lifting lid.

2. The system of claim 1, wherein the confinement lid is supported by the shielded lifting lid when the lid assembly is lifted by the lifting attachment of the shielded lifting lid.

3. The system of claim 1, wherein the first thickness of the confinement lid is less than the second thickness of the shielded lifting lid.

4. The system of claim 1, wherein the shielded lifting lid has a greater diameter than the confinement lid.

5. The system of claim 1, further comprising a plurality of mounting blocks attached to the canister in a circumferentially speaced apart manner, each of the mounting blocks including a plurality of threaded sockets.

6. The system of claim 5, wherein the first bolt holes are spaced circumferentially around a peripheral side of the shielded lifting lid, the first bolt holes being arranged for vertical alignment with the mounting blocks when the shielded lifting lid is placed on the top of the canister.

7. The system of claim 6, wherein the first bolt holes are arranged in circumferentially spaced apart clusters, each of the circumferentially spaced apart clusters of the first bolt holes being vertically aligned with the threaded sockets in a corresponding one of the mounting blocks when the shielded lifting lid is placed on the top of the canister.

8. The system of claim 6, wherein the second bolt holes are spaced circumferentially around a peripheral side of the shielded lifting lid.

9. The system of claim 6, wherein the some of the first bolt holes have a larger diameter than other one of the first bolt holes.

10. The system of claim 5, wherein each of the first mounting bolts has a shank which extends through a corresponding one of the second bolt holes in the shielding confinement lid and engages a corresponding one of the threaded sockets of the mounting blocks.

11. The system of claim 1, further comprising a plurality of second mounting bolts inserted through other ones of the first bolt holes in the shielded lifting lid and attaching the shielded lifting lid to the canister without engaging the confinement lid.

12. The system of claim 11, wherein the shielded lifting lid is operable to lift the canister.

13. The system of claim 1, further comprising a vertically adjustable basket insert disposed in the canister, the basket insert being configured to support a plurality of radioactive waste cylinders.

14. The system of claim 5, further comprising a radioactive contamination barrier covering a top of each of the mounting blocks for preventing radiation streaming.

15. The system of claim 14, wherein the contamination barrier is an annular flange attached to canister and disposed above the mounting blocks.

16. The system of claim 1, wherein the shielded lifting lid includes an annular shoulder which engages a mating annular rim on an outer overpack when the canister is inserted in the overpack.

17. The system of claim 1, wherein the confinement lid and the shielded lifting lid are independently bolted to the canister so that the shielded lifting lid is removable from the confinement lid and the canister without removing the confinement lid from the canister.

18. A radioactive waste container system comprising:

a canister having an interior chamber for holding radioactive waste and an open top;

a lid assembly comprising a lower confinement lid and an upper shielded lifting lid, the confinement lid being detachably bolted to the lifting lid;

the lifting lid including a plurality of first bolt holes having a first diameter and a plurality of second bolt holes having a second diameter, the first diameter being larger than the second diameter;

the confinement lid including a plurality of third bolt holes having a third diameter, wherein each of the third bolt holes is concentrically aligned with one of the first or second bolt holes of the lifting lid; and a plurality of first mounting bolts inserted through the first bolt holes and threadably attaching the confinement lid to the canister without engaging the lifting lid.

19. A method for storing radioactive waste using a container system, the method comprising:

detachably mounting a confinement lid to a shielded lifting lid, the confinement lid and shielded lifting lid collectively forming a lid assembly, wherein the shielded lifting lid comprises a plurality of first bolt and the confinement lid comprises a plurality of second bolt holes, the first and second bolt holes concentrically aligned;

placing a canister having an interior chamber for holding radioactive waste into an outer protective overpack;

lifting the lid assembly using the lifting lid;

placing the lid assembly on an open top of the canister;

attaching the confinement lid to the canister using a plurality of first mounting bolts, the firsts mounting bolts inserted through some of the first bolts holes in the shielded lifting lid without engaging the shielded lifting lid;

detaching the lifting lid from the confinement lid; and removing the lifting lid from the canister, the confinement lid remaining attached to the canister by the first mounting bolts.

* * * * *